US006176442B1

(12) United States Patent
Eicher et al.

(10) Patent No.: US 6,176,442 B1
(45) Date of Patent: Jan. 23, 2001

(54) DEVICE FOR MOUNTING A COMPONENT EXPOSED TO A PRESSURIZED FLUID

(75) Inventors: Joachim Eicher; Johannes Geser, both of Dortmund (DE)

(73) Assignee: Boehringer Ingelheim International GmbH, Ingelheim (DE)

( * ) Notice: Under 35 U.S.C. 154(b), the term of this patent shall be extended for 0 days.

(21) Appl. No.: 09/051,205

(22) PCT Filed: Oct. 4, 1996

(86) PCT No.: PCT/EP96/04310

§ 371 Date: Nov. 12, 1998

§ 102(e) Date: Nov. 12, 1998

(87) PCT Pub. No.: WO97/12683

PCT Pub. Date: Apr. 10, 1997

(30) Foreign Application Priority Data

Oct. 4, 1995 (DE) ..... 195 36 903

(51) Int. Cl.[7] ..... B05B 1/00
(52) U.S. Cl. ..... 239/591; 239/596; 239/602
(58) Field of Search ..... 239/589, 590, 239/591, 596, 602, 533.15, DIG. 12; 128/200.18, 200.14, 204.25

(56) References Cited

U.S. PATENT DOCUMENTS

| | | |
|---|---|---|
| 3,997,111 | 12/1976 | Thomas et al. . |
| 4,150,794 | 4/1979 | Higgins . |
| 4,244,521 | 1/1981 | Guse . |
| 4,313,570 | 2/1982 | Olsen . |
| 5,033,681 | 7/1991 | Munoz . |

FOREIGN PATENT DOCUMENTS

| | | |
|---|---|---|
| 41 15 131 A1 | 11/1991 | (DE) . |
| 046 664 | 3/1982 | (EP) . |
| WO 94/07607 | 4/1994 | (WO) . |

*Primary Examiner*—Andres Kashnikow
*Assistant Examiner*—Lisa Ann Douglas
(74) *Attorney, Agent, or Firm*—Sterne, Kessler Goldstein & Fox P.L.L.C.

(57) ABSTRACT

The mounting of a component subjected to pressure from a fluid requires special precautions if the component is made of wear resistant, hard and hence generally brittle material and may be destroyed by locally raised stresses. A fluidic component of this kind, made, for example, of silicon/glass is arranged in an elastomeric shaped component, made, for example, of silicon rubber. The inner contours of the elastomeric shaped component correspond to the outer contours of the fluidic component. The outer contours of the shaped component corresponds to the inner contours of a holder. Due to this "floating mounting" there are no unacceptable local pressure peaks and no deformation of the fluidic component. The device is particularly suitable for mounting a fluidic component made of glass or silicon, or miniature dimensions, subject to high pressure.

17 Claims, 3 Drawing Sheets

DEVICE FOR MOUNTING A COMPONENT EXPOSED TO A PRESSURIZED FLUID

BACKGROUND OF THE INVENTION

1. Field of the Invention

The invention relates to a device for holding a fluidic component, particularly nozzles or jets, particularly at high pressures. Holders for microstructured components, particularly microstructured nozzles are of particular interest.

The invention relates in particular to a device for holding a microstructured nozzle as used in nebulizers for producing propellant-free medicinal aerosols for inhalation.

2. Related Art

Nozzles of this kind are disclosed, for example, in WO 94/07607. A characteristic feature of these nozzles is that they generate inhalable droplets around 5 μm in size, the liquid which is to be nebulized being sprayed at high pressure (between 50 and 400 bar or more and optionally up to 600 bar) through a nozzle with an opening of less than 10 μm. Nozzles of this kind may be produced, for example, from thin silicon plates and glass plates and have external dimensions in the millimetre range. A typical nozzle consists, for example, of a box shape made up of two plates with edges measuring 1.1×1.5×2.0 mm in length. Nebulizers for producing propellant-free aerosols in which the devices for mounting a nozzle according to the invention may be used are known, for example, from WO 91/14468.

The aim of the invention is to provide a device of this kind which is preferably suitable for a fluidic component of wear-resistant, hard and consequently usually brittle material.

The term fluidic component refers to a component which is exposed to a pressurized fluid, whilst the pressure may also prevail inside the component, e.g. in a nozzle bore. A component of this kind may, for example, be mounted in pressure tight manner by pressing it into a holder of hard material, if the material of the component can withstand mechanical forces without breaking or being deformed to an unacceptable extent. For use at high pressures, seals of deformable material, e.g. copper, or hard materials are used, which can be compressed under considerable force. In the case of components made of brittle material, the known methods of mounting the component in pressure tight manner give rise to considerable expenditure and require great care. Only limited data can reliably be provided as to the service life of a fluidic component mounted in this way.

The objective is therefore to provide a device for holding a fluidic component, which is also suitable for components made of wear-resistant, hard and consequently usually brittle material, and which does not exhibit any unacceptably high pressure points in the material of the component.

SUMMARY OF THE INVENTION

This objective is achieved according to the invention by means of a device for holding a fluidic component which is subjected to a fluid pressure, characterised by

- a holder inside which the fluidic component is mounted, and which makes contact with the fluidic component at the low pressure end thereof,
- an elastomeric shaped component the outer contour of which corresponds to the inner contour of the holder and the inner contour of which corresponds to the outer contour of the fluidic component whilst
- the elastomeric shaped component surrounds the fluidic component around its entire perimeter, and

- the elastomeric shaped component has at least one free surface which is exposed to the pressurized fluid.

BRIEF DESCRIPTION OF THE DRAWINGS

FIG. 2 is a perspective view of a shaped component of the device according to the present invention;

FIG. 3 is a perspective view of a fluidic component of the device according to the present invention;

FIGS. 4*c* and 4*d* are cross-sectional views of a second embodiment of the device according to the present invention.

DETAILED DESCRIPTION OF THE PREFERRED EMBODIMENTS

Figure 1:
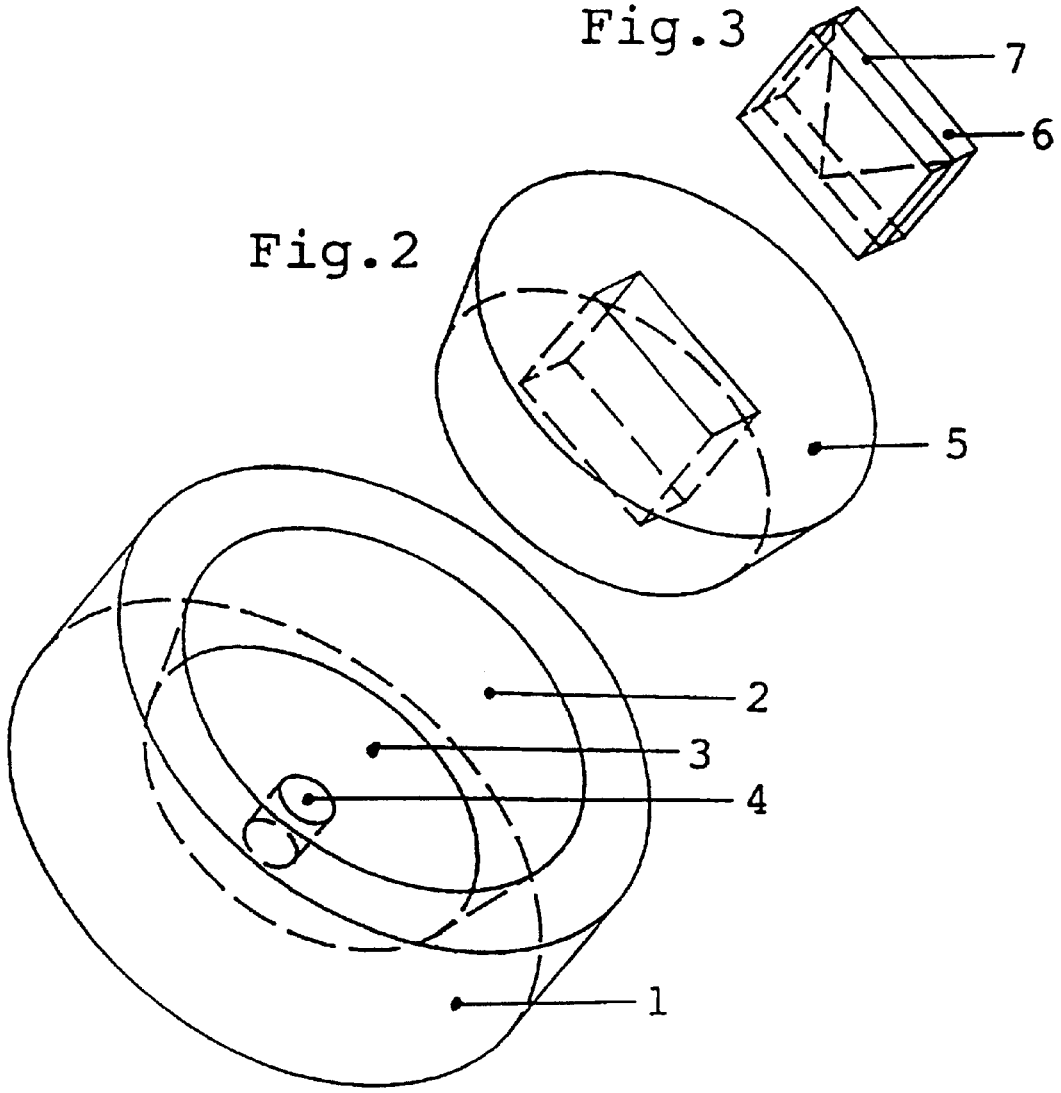
FIG. 1 is a perspective view of a holder of the device according to the present invention.

The elastomeric shaped component is preferably produced by injection moulding, in which the pre-elastomer is transferred free from bubbles into a mould which corresponds to the contours of the holder and the fluidic component. The pre-elastomer hardens in the mould, preferably under pressure.

The elastomeric component may also be produced at the place where it is intended to hold the fluid component.

An elastomeric shaped component of this kind behaves somewhat like an incompressible fluid. It fits perfectly with the holder and the fluidic component.

The elastomeric shaped component surrounds the fluidic component around its entire perimeter. The elastomeric shaped component is exposed to the fluid pressure only at the pressure end, not at the sides where it fits the holder and the fluidic component. The elastomeric component enables the pressure on the fluidic component to be equalised. The elastomeric component does not have any free surface at the low pressure end. The elastomeric component may consist, for example, of natural rubber or synthetic rubber such as silicon rubber or polyurethane.

The fluidic component may consist of wear resistant, hard and hence generally brittle material (such as silicon, glass, ceramic, gemstones, e.g. sapphire, ruby, diamond, or a ductile material having a wear resistant hard surface (such as plastics, copper, hard chromium plated copper, brass, aluminium, steel, steel with a hardened surface)). It may be made in one piece or be assembled from a number of pieces, and these pieces may consist of different materials. The fluidic component can have cavities, recesses or channel structures, e.g. a nozzle structure.

The holder may consist of virtually any desired material, preferably metal or plastics, and can be a rotational body or a body of any desired shape. It may be produced by moulding, casting or by machining.

It may be advisable, e.g. in the case of a cylindrical elastomeric shaped component, to subject the elastomeric shaped component to a constant mechanical force which subjects the elastomeric shaped component to prestressing. This can be achieved by press fitting or by means of one (or more) displacement members which exert pressure onto or into the elastomeric shaped component.

The apparatus according to the invention has the following advantages:

No unacceptable local pressure peaks are produced in the fluidic component, since the "floating mount" ensures that the fluid pressure inside and outside the fluidic component is at virtually the same level.

The forces exerted by the holder and the fluid pressure via the fitted elastomeric shaped component onto the fluidic component do not produce any deformation of the fluidic component.

A fluidic component consisting of a material which is to some extent ductile can be clamped in just the same way as a fluidic component made of brittle material.

The mounting of the fluidic component remains sealed even if the fluid pressure abates or a (slight) under pressure is formed.

The mounting is not sensitive to dynamic high pressure loads, e.g. caused by pressure surges.

The fluidic component and the elastomeric shaped component can easily be mounted in the holder without force and with no need for adjustment. For the fluidic component there is no risk of brittle fracture and for the elastomeric component there is no risk of it slipping out of the holder.

It is particularly suitable for a fluidic component of miniature dimensions.

The apparatus in accordance with the invention will be explained in more detail with reference to the drawings.

FIG. 1 shows a cylindrical holder 1 made of metal in an oblique view. It has a frustum-shaped recess 2, the diameter of which is somewhat greater at the high pressure end than at the low pressure end. In its base 3 the holder has an opening 4. The exterior of the holder may be frustum-shaped and the recess may be cylindrical.

FIG. 2 shows the elastomeric shaped component 5, the shape of which corresponds to the shape of the holder according to FIG. 1 and to the shape of the fluidic component according to FIG. 3.

FIG. 3 shows a fluidic component 6 consisting of two rectangular plates joined together at their contact surface. At least one of the plates is provided with a channel structure 7 which contains a nozzle on the low pressure side.

Figure 4B:
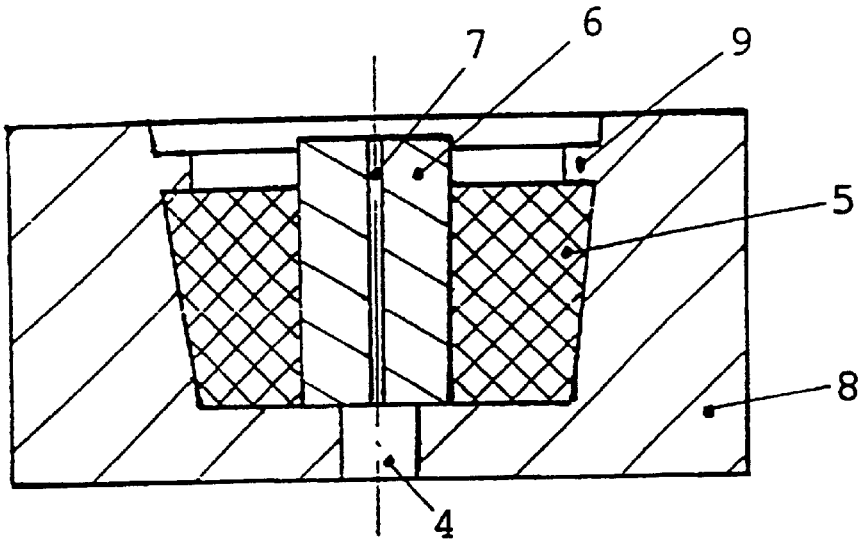
FIGS. 4*a* and 4*b* are cross-sectional views of the device according to the present invention.
Figure 4A:
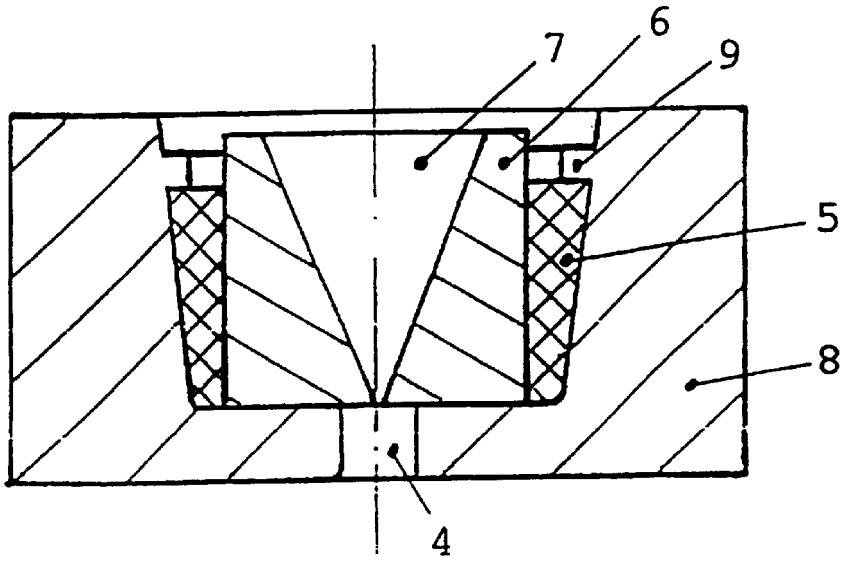

FIGS. 4*a* and 4*b* each show a cross-section through another embodiment of the apparatus, each in a plane lying along the axis of the device and in each case parallel to one side of the fluidic component. The holder 8 is provided with a ring 9 which projects beyond the edge of the elastomeric component.

FIGS. 4*c* and 4*d* show another embodiment of the device of the present invention in cross-section, similar to FIGS. 4*a* and 4*b*, the cross-section taken along a plane lying along the axis of the device parallel to one side of the fluidic component. A ring-shaped displacement member 18 is located at one side of a building element 19, shown in part. Building element 19 is part of the container (not shown) containing the fluid to be aerolised. When fixing the holder 8 to the container containing the fluid, the displacement member 18 is pressed into the elastomeric component 5. The displacement member 18 exposes the elastomeric component 5 to a steady mechanical force. The elastomeric component 5 is exposed to the pressure of the fluid only at the pressure side.

Figure 5:
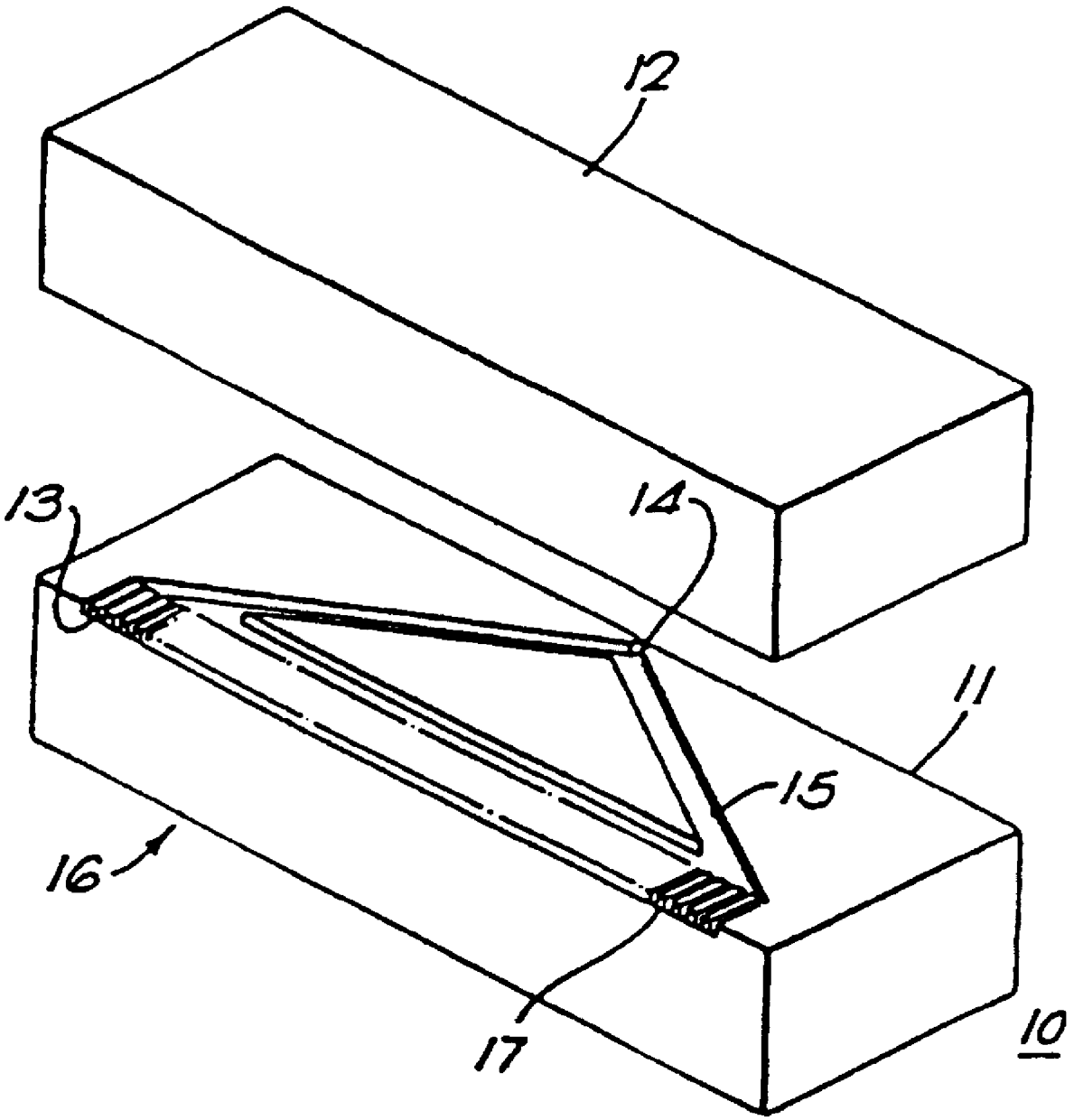
FIG. 5 is a perspective view of a nozzle arrangement according to the present invention.

FIG. 5 shows a microstructured fluidic component in the form of a nozzle arrangement 10, comprising a base plate 11 and a cover plate 12. To make the drawing clearer, the two plates are shown separately. In the finished state, the two plates are fixed together, so that the fluid which is to be nebulized penetrates through the filter arrangement 13 on the inlet side 16 (high pressure side) into the nozzle arrangement 10 and through the narrow channels 17 and the two wider channels 15 to the nozzle outlet 14 (low pressure side). The plates 11 and 12 may be made of silicon or glass. Other details of the nozzle are disclosed in W094/07607, to which reference is made herein.

EXAMPLE

Mounting for a Nebulizer Nozzle of Miniature Construction

This device consists of a cylindrical holder made of steel with an external diameter of 3.2 mm and a height of 2.6 mm. It contains a recess with an internal diameter of 2.3 mm at the high pressure end and 2.1 mm at the low pressure end. The base of the holder is 0.4 mm thick and contains a bore 0.8 mm in diameter.

The elastomeric shaped component made of silicon rubber is a frustum. Before it is inserted in the holder it has a diameter of 2.3 mm at the high pressure end and 2.2 mm at the low pressure end and is 1.8 mm high. It contains a recess, symmetrical with its axis, extending along its full height, with a width of 1.0 mm and a length of 1.4 mm.

The fluidic component is a box shape made up of two silicon plates, which is 1.1 mm wide, 1.5 mm long and 2.0 mm high. In the contact surface between the plates it contains a flat, triangular recess 400 $\mu$m thick, which terminates in a channel 50 $\mu$m wide, 50 $\mu$m thick and 200 $\mu$m long.

The device is fixed to a container which contains the fluid to be nebulized. The pressure of the fluid inside the fluidic component is 32 MPa (320 bar)

What is claimed is:

1. A device comprising:

a holder having a frustum-shaped recess formed therein;

a fluidic nozzle component mounted in said recess of said holder, wherein said holder makes contact with said fluidic component at a low pressure end of said fluidic component, said frustum-shaped recess having a greater diameter at a high pressure end of said fluidic component than at the low pressure end of said fluidic component; and a frustum-shaped component made of an elastomeric material, wherein an outer contour of said frustum-shaped component corresponds to an inner contour of said holder and an inner contour of said frustum-shaped component corresponds to an outer contour of said fluidic component, wherein said frustum-shaped component surrounds said fluidic component around a perimeter of said fluidic component, and wherein said frustum-shaped component has at least one free surface which is exposed to a pressurized fluid.

2. A device according to claim 1, wherein said fluidic component is made up of a plurality of pieces.

3. A device according to claim 1, wherein said fluidic component has a channel structure.

4. A device according to claim 3, wherein said fluidic component is made from a material selected from the group consisting of silicon, glass, and silicon/glass.

5. A device according to claim 1, wherein said fluidic component is in the form of a nozzle arrangement including a base plate and a cover plate with a nozzle outlet for nebulizing medicinal solutions for inhalation.

6. A device according to claim 1, wherein said fluidic component is made of a wear resistant, hard and brittle material.

7. A device according to claim 6, wherein said material is selected from the group consisting of silicon, glass, ceramic, and gemstone.

8. A device according to claim 1, wherein said fluidic component is made of a ductile material.

9. A device according to claim 8, wherein said ductile material is selected from the group consisting of plastic and metal.

10. A device according to claim 8, wherein said ductile material is selected from the group consisting of copper, hard chromium plated copper, brass, aluminum, steel, and steel with a hardened surface.

11. A device according to claim 1, wherein said fluidic component is made of a combination of a brittle material and a ductile material.

12. A device according to claim 1, wherein said shaped component is made of rubber.

13. A device according to claim 12, wherein said shaped component is made of a synthetic rubber.

14. A device according to claim 13, wherein said synthetic rubber is selected from the group consisting of silicon rubber and polyurethane.

15. A device according to claim 1, further comprising a displacement member which compresses said shaped component.

16. A device for holding a fluidic component according to claim 1, wherein a pressure of up to 600 bar prevails at a high pressure end of said fluidic component.

17. A nebulizer for producing propellant-free aerosols for inhalation comprising a device for holding a fluidic component according to claim 1.

* * * * *

UNITED STATES PATENT AND TRADEMARK OFFICE

CERTIFICATE OF CORRECTION

PATENT NO. : 6,176,442 B1
DATED : January 23, 2001
INVENTOR(S) : Eicher et al.

It is certified that error appears in the above-identified patent and that said Letters Patent is hereby corrected as shown below:

Drawings,
Add Figure 4c.

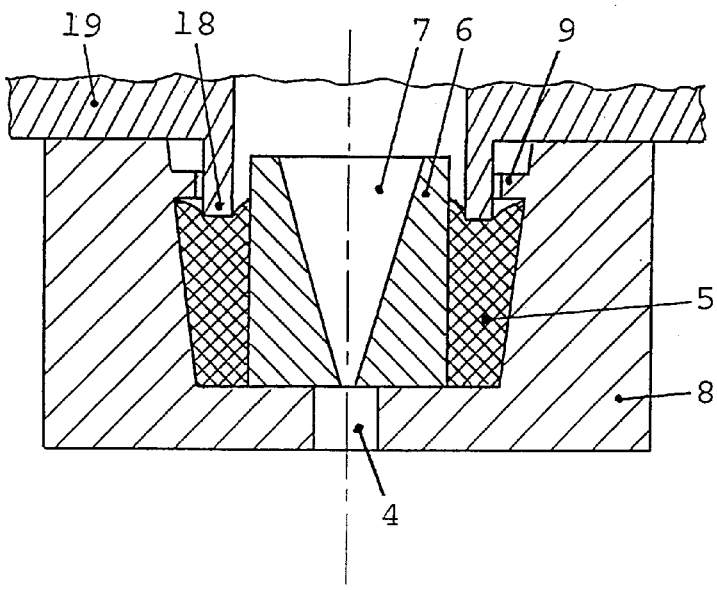

Fig.4c

UNITED STATES PATENT AND TRADEMARK OFFICE

CERTIFICATE OF CORRECTION

PATENT NO. : 6,176,442 B1
DATED : January 23, 2001
INVENTOR(S) : Eicher et al.

It is certified that error appears in the above-identified patent and that said Letters Patent is hereby corrected as shown below:

Drawings (con't),
Add Figure 4d.

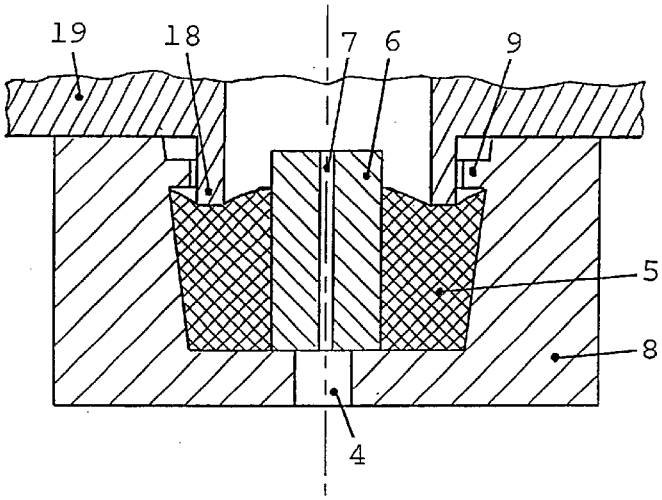

Fig.4d

Signed and Sealed this

Sixth Day of August, 2002

*Attest:*

*Attesting Officer*

JAMES E. ROGAN
*Director of the United States Patent and Trademark Office*